US011833637B2

(12) United States Patent
Soundararajan et al.

(10) Patent No.: US 11,833,637 B2
(45) Date of Patent: Dec. 5, 2023

(54) CONTROL OF STEAM GENERATION FOR CHEMICAL MECHANICAL POLISHING

(71) Applicant: Applied Materials, Inc., Santa Clara, CA (US)

(72) Inventors: Hari Soundararajan, Sunnyvale, CA (US); Shou-Sung Chang, Mountain View, CA (US); Calvin Lee, Oakland, CA (US); Jonathan P. Domin, Sunnyvale, CA (US); Shuchivrat Datar, Cupertino, CA (US); Dmitry Sklyar, San Jose, CA (US); Paul D. Butterfield, San Jose, CA (US); Chad Pollard, San Jose, CA (US); Haosheng Wu, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 17/360,907

(22) Filed: Jun. 28, 2021

(65) Prior Publication Data

US 2021/0402554 A1 Dec. 30, 2021

Related U.S. Application Data

(60) Provisional application No. 63/045,682, filed on Jun. 29, 2020.

(51) Int. Cl.

| | |
|---|---|
| ***B24B 37/015*** | (2012.01) |
| ***B24B 37/04*** | (2012.01) |
| ***F22B 35/00*** | (2006.01) |

(52) U.S. Cl.

CPC ..... *B24B 37/015* (2013.01); *B24B 37/042* (2013.01); *F22B 35/00* (2013.01)

(58) Field of Classification Search

CPC ..... B24B 37/015; B24B 49/14; B24B 41/007; B24B 53/017; F22B 1/284; F22B 1/285;

(Continued)

(56) References Cited

U.S. PATENT DOCUMENTS

| | | | |
|---|---|---|---|
| 4,450,652 A | 5/1984 | Walsh | |
| 5,088,242 A | 2/1992 | Lubbering et al. | |

(Continued)

FOREIGN PATENT DOCUMENTS

| | | | |
|---|---|---|---|
| CN | 207171777 | 4/2018 | |
| DE | 102007054457 A1 * | 5/2008 | ..... F22B 1/284 |

(Continued)

OTHER PUBLICATIONS

Translation of KR20040016495A (Year: 2004).*

(Continued)

*Primary Examiner* — Brian D Keller
*Assistant Examiner* — Steven Huang
(74) *Attorney, Agent, or Firm* — Fish & Richardson P.C.

(57) ABSTRACT

A chemical mechanical polishing system includes a steam generator with a heating element to apply heat to a vessel to generate steam, an opening to deliver steam onto a polishing pad, a first valve in a fluid line between the opening and the vessel, a sensor to monitor a steam parameter, and a control system. The control system causes the valve to open and close in accordance with a steam delivery schedule in a recipe, receive a measured value for the steam parameter from the sensor, receive a target value for the steam parameter, and perform a proportional integral derivative control algorithm with the target value and measured value as inputs so as to control the first valve and/or a second pressure release valve and/or the heating element such that the (Continued)

measured value reaches the target value substantially just before the valve is opened according to the steam delivery schedule.

20 Claims, 5 Drawing Sheets

(58) Field of Classification Search
CPC ..... F22B 1/28; F22B 35/00; F22B 35/005; F22B 35/105; F22B 35/18
USPC ..... 451/7, 53, 5
See application file for complete search history.

(56) References Cited

U.S. PATENT DOCUMENTS 5,196,353 A 3/1993 Sandhu et al.
5,597,442 A 1/1997 Chen et al.
5,605,487 A * 2/1997 Hileman ..... H01L 21/68707 451/41
5,643,050 A 7/1997 Chen
5,709,593 A 1/1998 Guthrie
5,722,875 A 3/1998 Iwashita et al.
5,738,574 A 4/1998 Tolles et al.
5,762,544 A 6/1998 Zuniga et al.
5,765,394 A 6/1998 Rhoades
5,851,135 A 12/1998 Sandhu et al.
5,851,846 A 12/1998 Matsui et al.
5,868,003 A 2/1999 Simas et al.
5,873,769 A 2/1999 Chiou et al.
5,957,750 A 9/1999 Brunelli
5,964,952 A 10/1999 Kunze-Concewitz
6,000,997 A 12/1999 Kao et al.
6,012,967 A 1/2000 Satake et al.
6,023,941 A 2/2000 Rhoades
6,095,898 A 8/2000 Hennofer et al.
6,121,144 A 9/2000 Marcyk et al.
6,151,913 A 11/2000 Lewis et al.
6,159,073 A 12/2000 Wiswesser et al.
6,206,760 B1 3/2001 Chang et al.
6,257,954 B1 7/2001 Ng et al.
6,257,955 B1 7/2001 Springer et al.
6,264,789 B1 7/2001 Pandey et al.
6,280,289 B1 8/2001 Wiswesser et al.
6,315,635 B1 11/2001 Lin
6,332,835 B1 12/2001 Nishimura et al.
6,399,501 B2 6/2002 Birang et al.
6,422,927 B1 7/2002 Zuniga
6,461,980 B1 10/2002 Cheung et al.
6,494,765 B2 12/2002 Gitis et al.
6,508,258 B1 1/2003 Lorimer
6,543,251 B1 4/2003 Gasteyer, III et al.
6,640,151 B1 10/2003 Somekh et al.
6,647,309 B1 11/2003 Bone
6,776,692 B1 8/2004 Zuniga et al.
6,829,559 B2 12/2004 Bultman et al.
7,008,295 B2 3/2006 Wiswesser et al.
7,016,750 B2 3/2006 Steinkirclmer et al.
7,196,782 B2 3/2007 Fielden et al.
9,005,999 B2 4/2015 Xu et al.
9,475,167 B2 10/2016 Maruyama et al.
9,579,768 B2 2/2017 Motoshima et al.
9,630,295 B2 4/2017 Peng et al.
9,782,870 B2 10/2017 Maruyama et al.
10,035,238 B2 7/2018 Maruyama et al.
2001/0055940 A1 12/2001 Swanson
2002/0039874 A1 4/2002 Hecker et al.
2002/0058469 A1 5/2002 Pinheiro et al.
2003/0055526 A1 3/2003 Avanzino et al.
2003/0186623 A1* 10/2003 Pham ..... B24B 37/12 451/7
2003/0211816 A1 11/2003 Liu et al.
2004/0029494 A1 2/2004 Banerjee et al.
2004/0097176 A1 5/2004 Cron
2005/0024047 A1 2/2005 Miller et al.
2005/0042877 A1 2/2005 Salfelder et al.
2005/0211377 A1 9/2005 Chen et al.
2007/0238395 A1 10/2007 Kimura et al.
2009/0258573 A1 10/2009 Muldowney et al.
2010/0047424 A1 2/2010 Cousin et al.
2010/0081360 A1 4/2010 Xu et al.
2010/0227435 A1 9/2010 Park et al.
2010/0279435 A1 11/2010 Xu et al.
2011/0159782 A1* 6/2011 Sone ..... B24B 37/015 451/7
2012/0034846 A1 2/2012 Minamihaba et al.
2012/0040592 A1 2/2012 Chen et al.
2012/0184107 A1 7/2012 Sato et al.
2012/0190273 A1 7/2012 Ono et al.
2013/0017328 A1 1/2013 Miyoshi et al.
2013/0023186 A1 1/2013 Motoshima et al.
2013/0045596 A1 2/2013 Eda et al.
2014/0187122 A1 7/2014 Ishibashi
2015/0090694 A1 4/2015 Hashimoto et al.
2015/0196988 A1 7/2015 Watanabe
2015/0224621 A1 8/2015 Motoshima et al.
2015/0224623 A1 8/2015 Xu et al.
2017/0232572 A1 8/2017 Brown
2017/0320188 A1 11/2017 Kweon et al.
2018/0236631 A1 8/2018 Eto et al.
2019/0096708 A1 3/2019 Sharma
2019/0143476 A1 5/2019 Wu
2020/0001426 A1 1/2020 Soundararajan et al.
2020/0001427 A1 1/2020 Soundararajan et al.
2020/0080446 A1* 3/2020 Cocuzza ..... F22B 35/00
2020/0262024 A1 8/2020 Chang et al.
2020/0376523 A1 12/2020 Wu et al.
2020/0406310 A1 12/2020 Soundararajan et al.

FOREIGN PATENT DOCUMENTS

JP H11-033897 2/1999
JP 2003-071709 3/2003
JP 2003-197586 7/2003
JP 2004-202666 7/2004
JP 2004-306173 11/2004
JP 2005-311246 11/2005
JP 2007-035973 2/2007
JP 2009-527716 A 7/2009
JP 2013-042066 2/2013
JP 2018-046260 3/2018
KR 10-2000-0025767 5/2000
KR 20-0241537 10/2001
KR 20-0326835 9/2003
KR 10-2004-0016495 2/2004
KR 20040016495 A * 2/2004
KR 10-2006-0076332 7/2006
KR 10-2009-0046468 5/2009
KR 10-2012-0084671 7/2012
KR 10-1816694 1/2018
KR 10-2020-0056015 5/2020
TW 201125071 7/2011
TW 201802994 1/2018
WO WO 1997/21057 6/1997
WO WO 2002/17411 2/2002
WO WO 2011/114960 9/2011
WO WO 2014/113220 7/2014
WO WO 2018/034308 2/2018
WO WO-2018034308 A1 * 2/2018 ..... B24B 37/015

OTHER PUBLICATIONS

Translation of WO-2018034308-A1 (Year: 2018).*
Translation of DE 102007054457 A1 (Year: 2008).*
Banerjee et al., "Post CMP Aqueous and CO2 Cryogenic Cleaning Technologies for Low k and Copper Integration," CMPUG Symposium, Poster Abstract, Jan. 2015, 2 pages.
International Search Report and Written Opinion in International Appln. No. PCT/US2021/039442, dated Oct. 6, 2021, 11 pages.
Sampumo et al., "Pad Surface Thermal Management during Copper Chemical Mechanical Planarization," Presented Oct. 1, 2015, at lie International Conference onPlanarization/CMP Technology, 2015, Sep. 30-Oct. 2, 2015, Session D-4, Chandler, AZ, USA, 24 pages.

(56) References Cited

OTHER PUBLICATIONS

Wiki.com [online], "PID controller," Nov. 1, 2021, retrieved on Nov. 3, 2021, retrieved from URL <https://en.wikipedia.org/wiki/PID_controlled>, 28 pages.
Wu et al., "Pad Surface Thermal Management during Copper Chemical: Mechanical Planarization," ECS Journal of Solid State Science and Technology, Apr. 2015, 4(7):P206-12.
Office Action in Taiwanese Appln. No. 110123744, dated Aug. 5, 2022, 15 pages (with English search report).
Office Action in Japanese Appln. No. 2022-544714, dated Sep. 26, 2023, 9 pages (with English translation).

* cited by examiner

CONTROL OF STEAM GENERATION FOR CHEMICAL MECHANICAL POLISHING

CROSS-REFERENCE TO RELATED APPLICATIONS

This application claims priority to U.S. Provisional Application Ser. No. 63/045,682, filed on Jun. 29, 2020, the disclosure of which is incorporated by reference.

TECHNICAL FIELD

The present disclosure relates to control of generation of steam for substrate processing tools, e.g., for chemical mechanical polishing (CMP).

BACKGROUND

An integrated circuit is typically formed on a substrate by the sequential deposition of conductive, semiconductive, or insulative layers on a semiconductor wafer. A variety of fabrication processes require planarization of a layer on the substrate. For example, one fabrication step involves depositing a filler layer over a non-planar surface and polishing the filler layer until the top surface of a patterned layer is exposed. As another example, a layer can be deposited over a patterned conductive layer and planarized to enable subsequent photolithographic steps.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing slurry with abrasive particles is typically supplied to the surface of the polishing pad.

The polishing rate in the polishing process can be sensitive to temperature. Various techniques to control temperature during polishing have been proposed.

SUMMARY

A chemical mechanical polishing system includes a platen to support a polishing pad, a carrier head to hold a substrate in contact with the polishing pad, a motor to generate relative motion between the platen and the carrier head, a steam generator including a vessel having a water inlet and a steam outlet and a heating element configured to apply heat to a portion of lower chamber to generate steam, an arm extending over the platen having at least one opening oriented to deliver steam from the steam generator onto the polishing pad, a first valve in a fluid line between the opening and the steam outlet to controllably connect and disconnect the opening and the steam outlet, a sensor to monitor a steam parameter, and a control system coupled to the sensor, the valve and optionally to the heating element. The control system is configured to cause the valve to open and close in accordance with a steam delivery schedule in a polishing process recipe stored as data in a non-transitory storage device, receive a measured value for the steam parameter from the sensor, receive a target value for the steam parameter, and perform a proportional integral derivative control algorithm with the target value and measured value as inputs so as to control the first valve and/or a second pressure release valve and/or the heating element such that the measured value reaches the target value substantially just before the valve is opened according to the steam delivery schedule.

Possible advantages may include, but are not limited to, one or more of the following.

Steam, i.e., gaseous $H_2O$ generated by boiling, can be generated in sufficient quantity to permit steam heating of the polishing pad before polishing of each substrate, and the steam can be generated at a consistent pressure from wafer-to-wafer. Polishing pad temperature, and thus polishing process temperature, can be controlled and be more uniform on a wafer-to-wafer basis, reducing wafer-to-wafer non-uniformity (WIWNU). Generation of excess steam can be minimized, improving energy efficiency. The steam can be substantially pure gas, e.g., have little to no suspended liquid in the steam. Such steam, also known as dry steam, can provide a gaseous form of $H_2O$ that has a higher energy transfer and lower liquid content than other steam alternatives such as flash steam.

The details of one or more implementations are set forth in the accompanying drawings and the description below. Other aspects, features, and advantages will be apparent from the description and drawings, and from the claims.

DETAILED DESCRIPTION

Figure 1A:
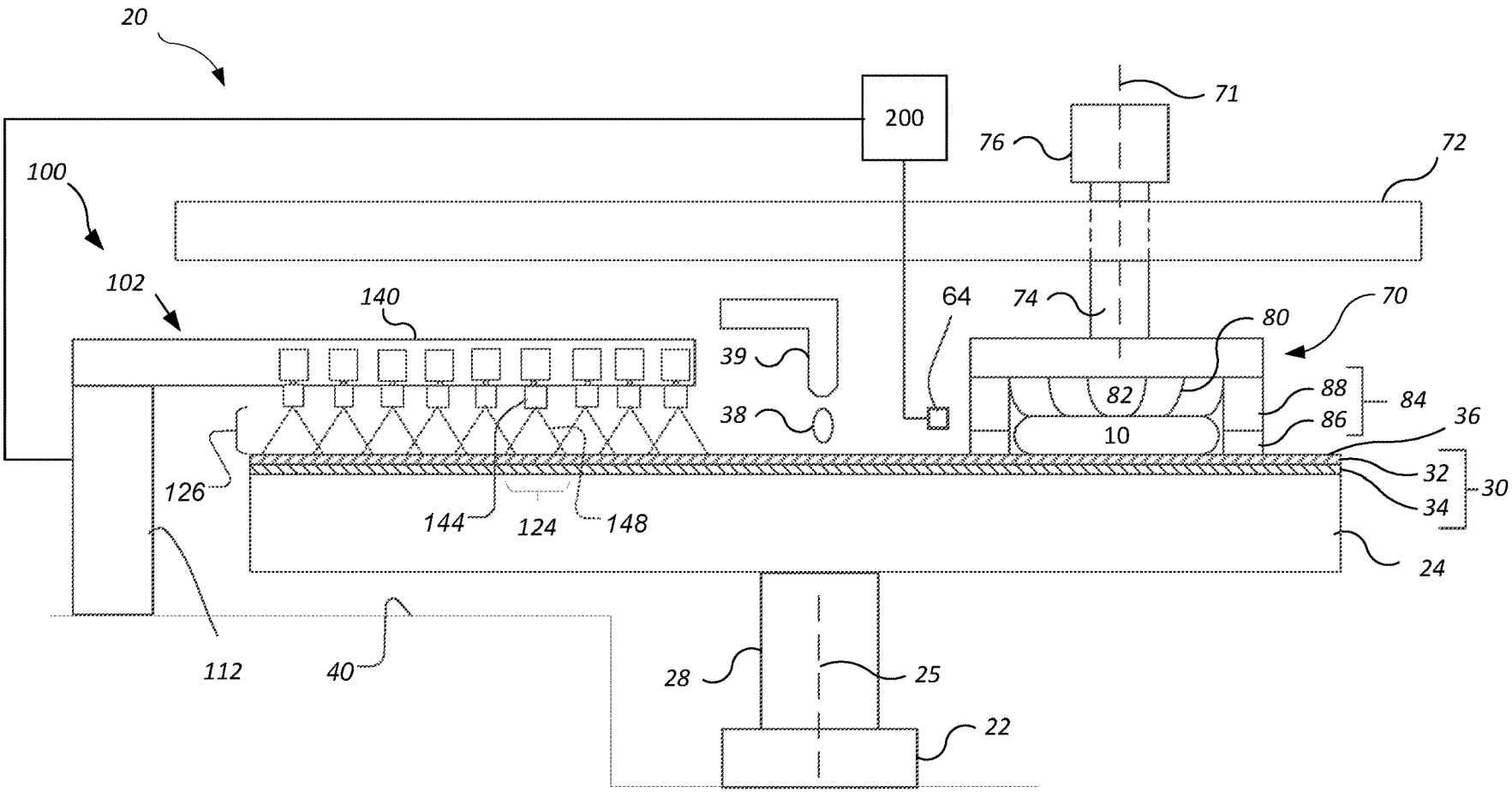
FIG. 1A is a schematic cross-sectional view of an example of a polishing station of the polishing apparatus.

Chemical mechanical polishing operates by a combination of mechanical abrasion and chemical etching at the interface between the substrate, polishing liquid, and polishing pad. During the polishing process, a significant amount of heat is generated due to friction between the surface of the substrate and the polishing pad. In addition, some processes also include an in-situ pad conditioning step in which a conditioning disk, e.g., a disk coated with abrasive diamond particles, is pressed against the rotating polishing pad to condition and texture the polishing pad surface. The abrasion of the conditioning process can also generate heat. For example, in a typical one minute copper CMP process with a nominal downforce pressure of 2 psi and removal rate of 8000 Å/min, the surface temperature of a polyurethane polishing pad can rise by about 30° C.

On the other hand, if the polishing pad has been heated by previous polishing operations, when a new substrate is initially lowered into contact with the polishing pad, it is at a lower temperature, and thus can act as a heat sink. Similarly, slurry dispensed onto the polishing pad can act as a heat sink. Overall, these effects result in variation of the temperature of the polishing pad spatially and over time.

Both the chemical-related variables in a CMP process, e.g., as the initiation and rates of the participating reactions, and the mechanical-related variables, e.g., the surface friction coefficient and viscoelasticity of the polishing pad, are strongly temperature dependent. Consequently, variation in the surface temperature of the polishing pad can result in changes in removal rate, polishing uniformity, erosion, dishing, and residue. By more tightly controlling the temperature of the surface of the polishing pad during polishing, variation in temperature can be reduced, and polishing performance, e.g., as measured by within-wafer non-uniformity or wafer-to-wafer non-uniformity, can be improved.

One technique that has been proposed to control the temperature of the chemical mechanical polishing process is to spray steam onto the polishing pad. Steam might be superior to hot water because less steam may be required to impart an equivalent amount of energy as hot water, e.g., due to the latent heat of the steam.

In a typical polishing process, steam is applied in a duty cycle (typically measured as a percentage of the total time from start of polishing of one wafer to start of polishing of a subsequent wafer) that can range from 1% to 100%. If the duty cycle is lower than 100%, the steam generation cycle can be split into two sections: a recuperation phase and a dispense phase.

Typically in the recuperation phase the vessel for steam generation is considered closed, i.e., the valve(s) are closed, so that steam cannot escape the vessel. Power is applied to a heater, e.g., a resistive heater, to input heat energy to the liquid water in the vessel. In addition, liquid water may flow into the vessel to replace water lost in a previous dispense cycle.

In the dispense phase, the valves are opened so that the steam is dispensed. The steam generator might not be able to keep up with the flow rate of steam during the dispense phase, in which case the dispense phase is accompanied by a pressure drop in the vessel. In some situations, when the heated liquid water exposed to atmosphere, there can be an abrupt a phase change to gas, commonly referred to as flash steam.

In general, during the recuperation phase, the goal is to add sufficient thermal energy to get steam ready for the next dispense phase, as dictated by parameters (temperature, flow rate, pressure) that may be required for the process. In some cases, e.g., a 20 sec dispense phase followed by an 80 sec recuperation phase, the required steam pressure can be achieved well before the beginning of the next dispense cycle. In this scenario, the power to the heater can turned off so as to avoid bringing the steam above the required parameters, e.g. pressure. However, the vessel is not a perfect insulator, so some heat loss can occur, and the steam may not stay at the desired parameters. Alternatively, power to the heater can be maintained, and excess steam can relieved, e.g., vented, to keep the required parameters, e.g. pressure. However, this consumes excess energy and is not energy efficient.

To address this issue, during a recuperation phase a control system can control power applied to the heater, e.g., using a proportional integral derivative control algorithm, in such a way that the required parameters are achieved just before the beginning of the next dispense phase.

Figure 1B:
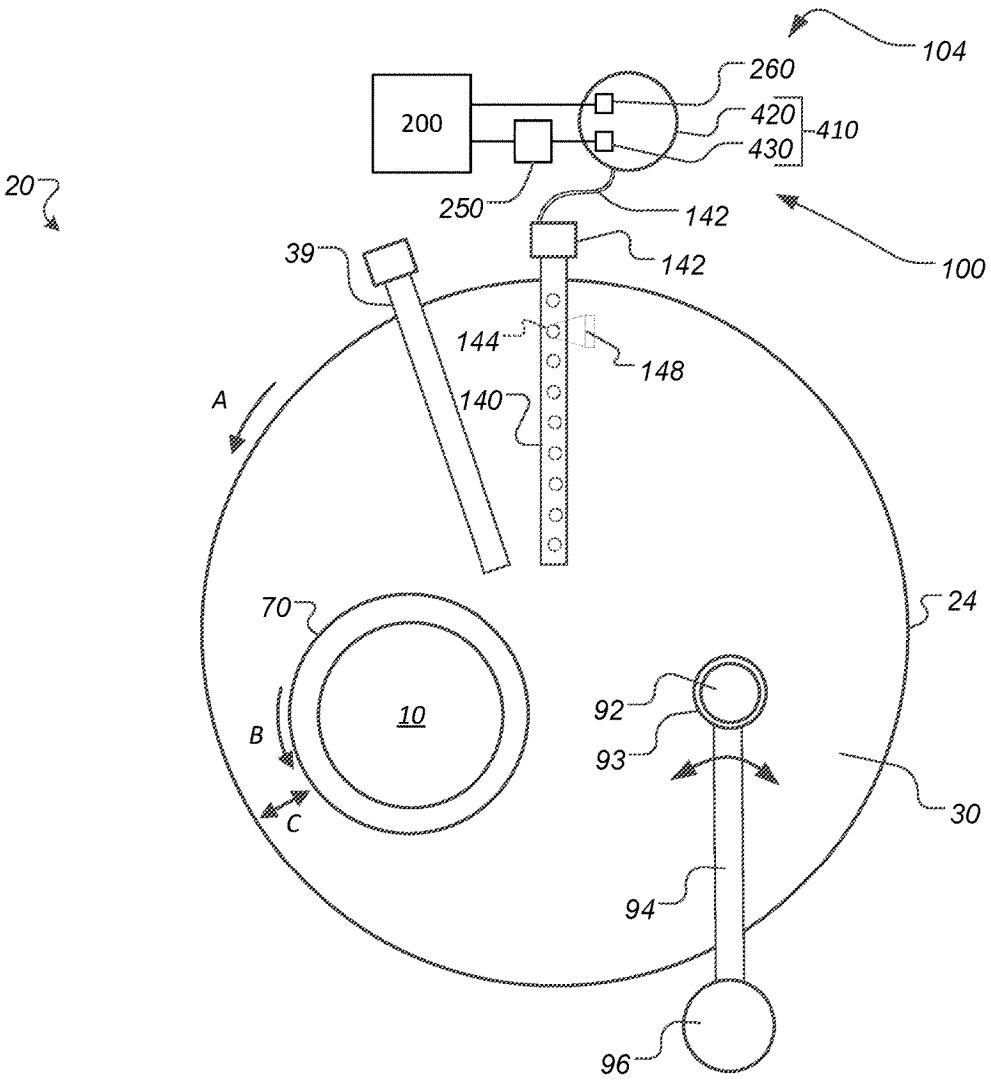
FIG. 1B is a schematic top view of an example polishing station of the chemical mechanical polishing apparatus.

FIGS. 1A and 1B illustrate an example of a polishing station 20 of a chemical mechanical polishing system. The polishing station 20 includes a rotatable disk-shaped platen 24 on which a polishing pad 30 is situated. The platen 24 is operable to rotate (see arrow A in FIG. 1B) about an axis 25. For example, a motor 22 can turn a drive shaft 28 to rotate the platen 24. The polishing pad 30 can be a two-layer polishing pad with an outer polishing layer 34 and a softer backing layer 32.

The polishing station 20 can include a supply port, e.g., at the end of a slurry supply arm 39, to dispense a polishing liquid 38, such as an abrasive slurry, onto the polishing pad 30. The polishing station 20 can also include a pad conditioner with a conditioner disk to maintain the surface roughness of the polishing pad 30.

A carrier head 70 is operable to hold a substrate 10 against the polishing pad 30. The carrier head 70 is suspended from a support structure 72, e.g., a carousel or a track, and is connected by a drive shaft 74 to a carrier head rotation motor 76 so that the carrier head can rotate about an axis 71. Optionally, the carrier head 70 can oscillate laterally, e.g., on sliders on the carousel, by movement along the track, or by rotational oscillation of the carousel itself.

The carrier head 70 can include a flexible membrane 80 having a substrate mounting surface to contact the back side of the substrate 10, and a plurality of pressurizable chambers 82 to apply different pressures to different zones, e.g., different radial zones, on the substrate 10. The carrier head 70 can include a retaining ring 84 to hold the substrate. In some implementations, the retaining ring 84 may include a lower plastic portion 86 that contacts the polishing pad, and an upper portion 88 of a harder material, e.g., a metal.

In operation, the platen is rotated about its central axis 25, and the carrier head is rotated about its central axis 71 (see arrow B in FIG. 1B) and translated laterally (see arrow C in FIG. 1B) across the top surface of the polishing pad 30.

In some implementations, the polishing station 20 includes a temperature sensor 64 to monitor a temperature in the polishing station or a component of/in the polishing station, e.g., the temperature of the polishing pad 30 and/or slurry 38 on the polishing pad. For example, the temperature sensor 64 could be an infrared (IR) sensor, e.g., an IR camera, positioned above the polishing pad 30 and configured to measure the temperature of the polishing pad 30 and/or slurry 38 on the polishing pad. In particular, the temperature sensor 64 can be configured to measure the temperature at multiple points along the radius of the polishing pad 30 in order to generate a radial temperature profile. For example, the IR camera can have a field of view that spans the radius of the polishing pad 30.

In some implementations, the temperature sensor is a contact sensor rather than a non-contact sensor. For example, the temperature sensor 64 can be thermocouple or IR thermometer positioned on or in the platen 24. In addition, the temperature sensor 64 can be in direct contact with the polishing pad.

In some implementations, multiple temperature sensors could be spaced at different radial positions across the polishing pad 30 in order to provide the temperature at multiple points along the radius of the polishing pad 30. This technique could be use in the alternative or in addition to an IR camera.

Although illustrated in FIG. 1A as positioned to monitor the temperature of the polishing pad 30 and/or slurry 38 on the pad 30, the temperature sensor 64 could be positioned inside the carrier head 70 to measure the temperature of the substrate 10. The temperature sensor 64 can be in direct contact (i.e., a contacting sensor) with the semiconductor wafer of the substrate 10. In some implementations, multiple temperature sensors are included in the polishing station 22, e.g., to measure temperatures of different components of/in the polishing station.

The polishing system 20 also includes a temperature control system 100 to control the temperature of the polishing pad 30 and/or slurry 38 on the polishing pad. The temperature control system 100 includes a heating system 104 that operates by delivering a temperature-controlled medium onto the polishing surface 36 of the polishing pad 30 (or onto a polishing liquid that is already present on the polishing pad). In particular, the medium includes steam, e.g., from the steam generator 410 (see FIG. 2A). The steam can be mixed with another gas, e.g., air, or a liquid, e.g., heated water, or the medium can be substantially pure steam. In some implementations, the additives or chemicals are added to the steam.

The medium can be delivered by flowing through apertures, e.g., holes or slots, e.g., provided by one or more nozzles, on a heating delivery arm. The apertures can be provided by a manifold that is connected to a source of the heating medium.

An example heating system 104 includes an arm 140 that extends over the platen 24 and polishing pad 30 from an edge of the polishing pad to or at least near (e.g., within 5% of the total radius of the polishing pad) the center of polishing pad 30. The arm 140 can be supported by a base 142, and the base 142 can be supported on the same frame 40 as the platen 24. The base 142 can include one or more an actuators, e.g., a linear actuator to raise or lower the arm 140, and/or a rotational actuator to swing the arm 140 laterally over the platen 24. The arm 140 is positioned to avoid colliding with other hardware components such as the polishing head 70, pad conditioning disk 92, and the slurry dispensing arm 39.

Multiple openings 144 are formed in the bottom surface of the arm 140. Each opening 144 is configured to direct a gas or vapor, e.g., steam, onto the polishing pad 30. The arm 140 can be supported by a base 142 so that the openings 144 are separated from the polishing pad 30 by a gap 126. The gap 126 can be 0.5 to 5 mm. In particular, the gap 126 can be selected such that the heat of the heating fluid does not significantly dissipate before the fluid reaches the polishing pad. For example, the gap can be selected such that steam emitted from the openings does not condense before reaching the polishing pad.

The heating system 104 can include a source of steam, e.g., a steam generator 410. The steam generator 410 are be connected to openings 144 in the arm 140 by a fluid delivery line 146, which can be provide by piping, flexible tubing, passages through solid body that provides the arm 140, or a combination thereof.

The steam generator includes 410 a vessel 420 to hold water, and a heater 430 to deliver heat to water in the vessel 420. Power can be delivered to the heater 430 from a power supply 250. A sensor 260 can be located in the vessel 420 or in the fluid delivery line 146 to measure a physical parameter, e.g., temperature or pressure, of the steam.

In some implementations, a process parameter, e.g., flow rate, pressure, temperature, and/or mixing ratio of liquid to gas, can be independently controlled for each nozzle. For example, the fluid for each opening 144 can flow through an independently controllable heater to independently control the temperature of the heating fluid, e.g., the temperature of the steam.

The various openings 144 can direct steam 148 onto different radial zones 124 on the polishing pad 30. Adjacent radial zones can overlap. Optionally, some of the openings 144 can be oriented so that a central axis of the spray from that opening is at an oblique angle relative to the polishing surface 36. Steam can be directed from one or more of the openings 144 to have a horizontal component in a direction opposite to the direction of motion of polishing pad 30 in the region of impingement as caused by rotation of the platen 24.

Although FIG. 1B illustrates the openings 144 as spaced at even intervals, this is not required. The nozzles 120 could be distributed non-uniformly either radially, or angularly, or both. For example, openings 144 could be clustered more densely toward the center of the polishing pad 30. As another example, openings 144 could be clustered more densely at a radius corresponding to a radius at which the polishing liquid 39 is delivered to the polishing pad 30 by the slurry delivery arm 39. In addition, although FIG. 1B illustrates nine openings, there could be a larger or smaller number of openings.

The temperature of the steam 148 can be 90 to 200° C. when the steam is generated (e.g., in the steam generator 410 in FIG. 2A). The temperature of the steam can be between 90 to 150° C. when the steam is dispensed by the nozzles 144, e.g., due to heat loss in transit. In some implementations, steam is delivered by the nozzles 144 at a temperature of 70-100° C., e.g., 80-90° C. In some implementations, the steam delivered by the nozzles is superheated, i.e., is at a temperature above the boiling point (for its pressure).

The flow rate of the steam can be 1-1000 cc/minute when the steam is delivered by the nozzles 144, depending on heater power and pressure. In some implementations, the steam is mixed with other gases, e.g., is mixed with normal atmosphere or with $N_2$. Alternatively, the fluid delivered by the nozzles 120 is substantially purely water. In some implementations, the steam 148 delivered by the nozzles 120 is mixed with liquid water, e.g., aerosolized water. For example, liquid water and steam can be combined at a relative flow ratio (e.g., with flow rates in sccm) 1:1 to 1:10. However, if the amount of liquid water is low, e.g., less than 5 wt %, e.g., less than 3 wt %, e.g., less than 1 wt %, then the steam will have superior heat transfer qualities. Thus, in some implementations the steam is dry steam, i.e., is substantially free of water droplets.

The polishing system 20 can also include a cooling system, e.g., an arm with apertures to dispense a coolant fluid onto the polishing pad, a high pressure rinsing system, e.g., an arm with nozzles to spray a rinsing liquid onto the polishing pad, and a wiper blade or body to evenly distribute the polishing liquid 38 across the polishing pad 30.

Figure 2:
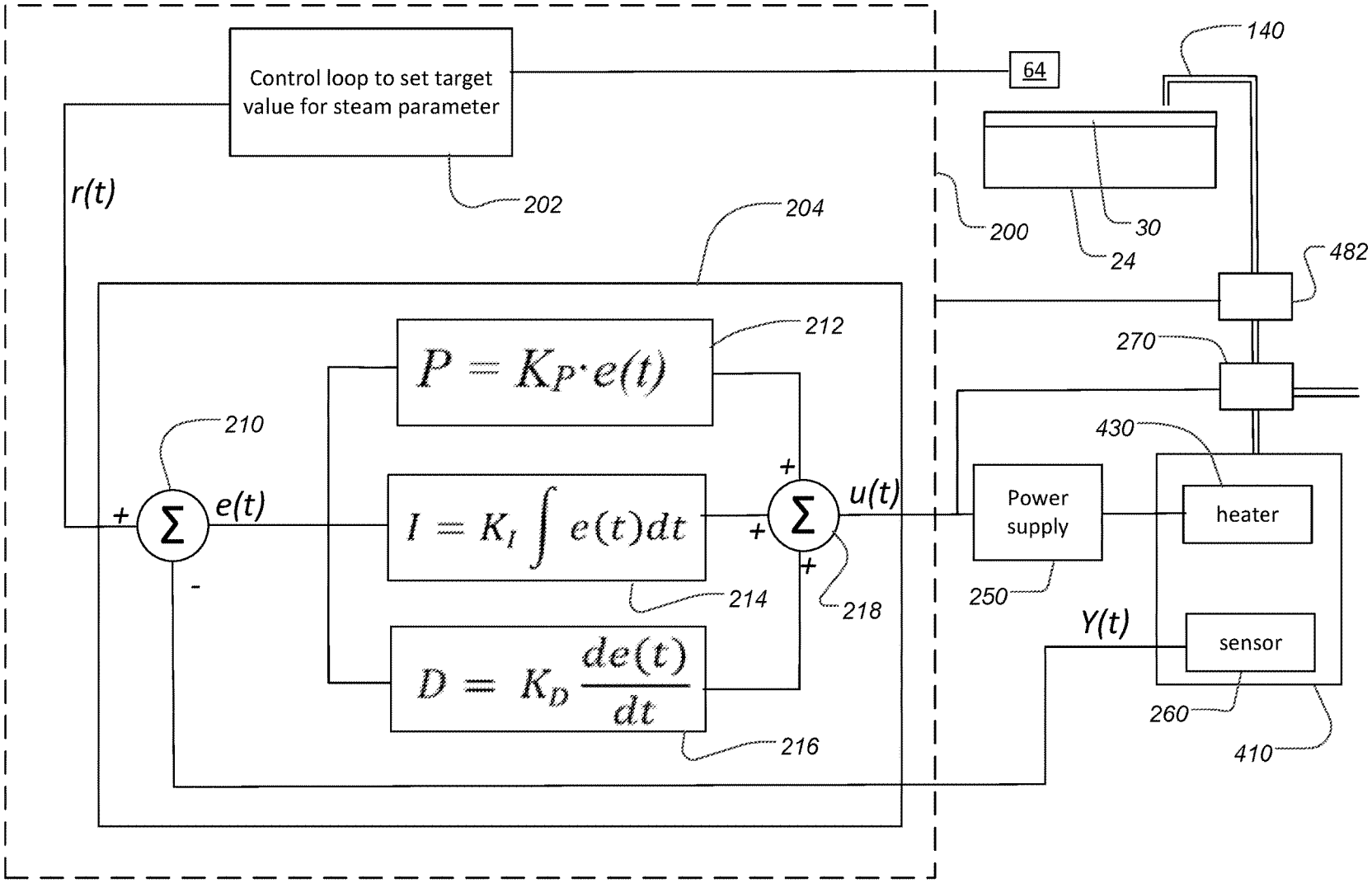
FIG. 2 illustrates a control system that includes a proportional integral derivative control algorithm that can be performed to control power to a steam generator.

Referring to FIG. 2, the polishing system 20 also includes a control system 200 to control operation of various components, e.g., the temperature control system 100, as well as rotation of the carrier head, rotation of the platen, pressure applied by chambers in the carrier head, etc.

The control system 200 can be configured to receive the pad temperature measurements from the temperature sensor 64. The control system implements a first control loop 202 that can set a target parameter for the steam on a cycle-to-cycle basis (each cycle includes a recuperation phase and a dispense phase as discussed above). In brief, the control loop 202 can compare the measured pad temperature to a target pad temperature, and generate a feedback signal. The feedback signal is used to calculate a revised target parameter for the steam so as to reach the target pad temperature. For example, if the measured pad temperature did not reach the target pad temperature in a prior dispense phase then the feedback signal will cause the temperature control system 200 to deliver more heat to the polishing pad in a subsequent dispense phase, whereas if the measured pad temperature exceeded the target pad temperature in a prior dispense phase then the feedback signal will cause the temperature control system 200 to deliver less heat to the polishing pad in a subsequent dispense phase.

Several techniques can be used, singly or in combination, to control the amount of heat delivered to the polishing pad from dispense phase to dispense phase. First, the duration during which the steam is delivered, e.g., the duty cycle, can be increased (to deliver more heat) or decreased (to deliver less heat). Second, the temperature at which the steam is delivered can be increased (to deliver more heat) or decreased (to deliver less heat). Third, the pressure at which the steam is delivered can be increased (to deliver more heat) or decreased (to deliver less heat).

Thus, if the measured pad temperature did not reach the target pad temperature, then the feedback signal can cause the control loop 202 to increase the target steam temperature, pressure and/or duty cycle for the subsequent dispense phase. On the other hand, if the measured pad temperature exceeded the target pad temperature in a prior dispense phase, then the feedback signal will cause the control loop 202 to decrease the target steam temperature, pressure and/or duty cycle. As a result a parameter target value, r(t), e.g., a target value for the pressure or temperature, of the steam can vary on a cycle-to-cycle basis. In some implementations, rather than operating on a cycle-to-cycle basis, the control loop can operate on a continuous basis, continuously monitoring the temperature of the polishing pad 30 and adjusting the parameter target value, r(t), as polishing progresses.

The parameter target value, r(t), is output from the control loop 202 to a proportional integral derivative (PID) controller 204 that performs a proportional integral derivative control algorithm to control the power applied by the power supply 250 to the heater 430. The PID controller 204 can be connected to the sensor 260 to receive measurements, Y(t), of the parameter, e.g., temperature or pressure. The PID controller 204 can be tuned such that the target parameter value is achieved just before the beginning of the next dispense phase. For example, the target parameter can be reached less than 180 seconds, e.g., less than 60 seconds, e.g., less than 30 seconds, e.g., less than 10 seconds, e.g., less than 3 seconds, e.g., less than 1 second, before the valve is opened.

In the PID controller 204, target parameter value, r(t), is compared to the measured parameter value, Y(t), from the sensor 260, by a comparator 210. The comparator outputs an error signal, e(t), based on the difference.

The error signal is input to a proportional value calculator 212, which calculates a first proportional output P. The proportional output P can be calculated based on $$P=K_P e(t)$$

where $K_P$ is a weight set during tuning. The error signal, e(t), is also input to an integral value calculator 214, which calculates a second integral output I. The integral output I can be calculated based on $$I=K_I \int e(t)dt$$

where $K_I$ is a weight set during tuning. The error signal, e(t), is also input to a derivative value calculator 216, which calculates a third derivative output D. The derivative output D can be calculated based on $$D = K_D \frac{de(t)}{dt}$$

where $K_D$ is a weight set during tuning.

The proportional output P, integral output I, and derivative output D are summed by a sum calculator 218, to output a control signal, u(t), which sets the power output by the power supply 250 to the heater 430.

In general, in tuning the PID controller 204, it is desirable to keep $K_P$ as low as possible. Then $K_I$ and $K_D$ can be increased as necessary based on overshoot and settling time such that the target parameter value is achieved just before the beginning of the next dispense phase. A variety of PID tuning methods are available, such as the Cohen-Coon method, the Ziegler-Nichols method, the Tyreus-Luyben method, and the Autotune Method. In some implementations the amount of heat applied is controlled under the assumption that the duty cycle of the valve is constant. In this case the gain values $K_I$, $K_P$, and $K_D$ need not be varied from cycle to cycle. However, in some implementations, if the duty cycle changes from cycle to cycle, then $K_I$, $K_P$, and $K_D$ can be adjusted for each duty cycle. For example, the once the duty cycle is calculated, the gain values can be selected based on a look-up-table that associates the gain values $K_I$, $K_P$, and $K_D$ with the duty cycle percentatages.

In some implementations, rather than controlling heat applied by the heater 430, the PID controller 204 can control a flow meter or valve 270 that can bleed pressure off the vessel in the steam generator 410. In this case, the flow meter or valve is controlled to bleed off pressure to maintain the steam pressure at a target pressure value. If implemented as a valve, the valve can be opened and closed with a duty cycle that depends on the control signal, u(t). If implemented as a flow meter, the control signal, u(t), can control the flow rate through the regulator, e.g., by adjusting an aperture size. In some implementations, the PID controller 204 can control the valve 438; in this case the steam is discharged through the opening in the arm.

The control system 200, and the functional operations thereof, can be implemented in digital electronic circuitry, in tangibly-embodied computer software or firmware, in computer hardware, or in combinations of one or more of them. The computer software can be implemented as one or more computer programs, i.e., one or more modules of computer program instructions encoded on a tangible non transitory storage medium for execution by, or to control the operation of, a processor of a data processing apparatus. The electronic circuitry and data processing apparatus can include a general purpose programmable computer, a programmable digital processor, and/or multiple digital processors or computers, as well as be special purpose logic circuitry, e.g., an FPGA (field programmable gate array) or an ASIC (application specific integrated circuit).

For the control system to be "configured to" perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, cause the apparatus to perform the operations or actions.

Figure 3A:
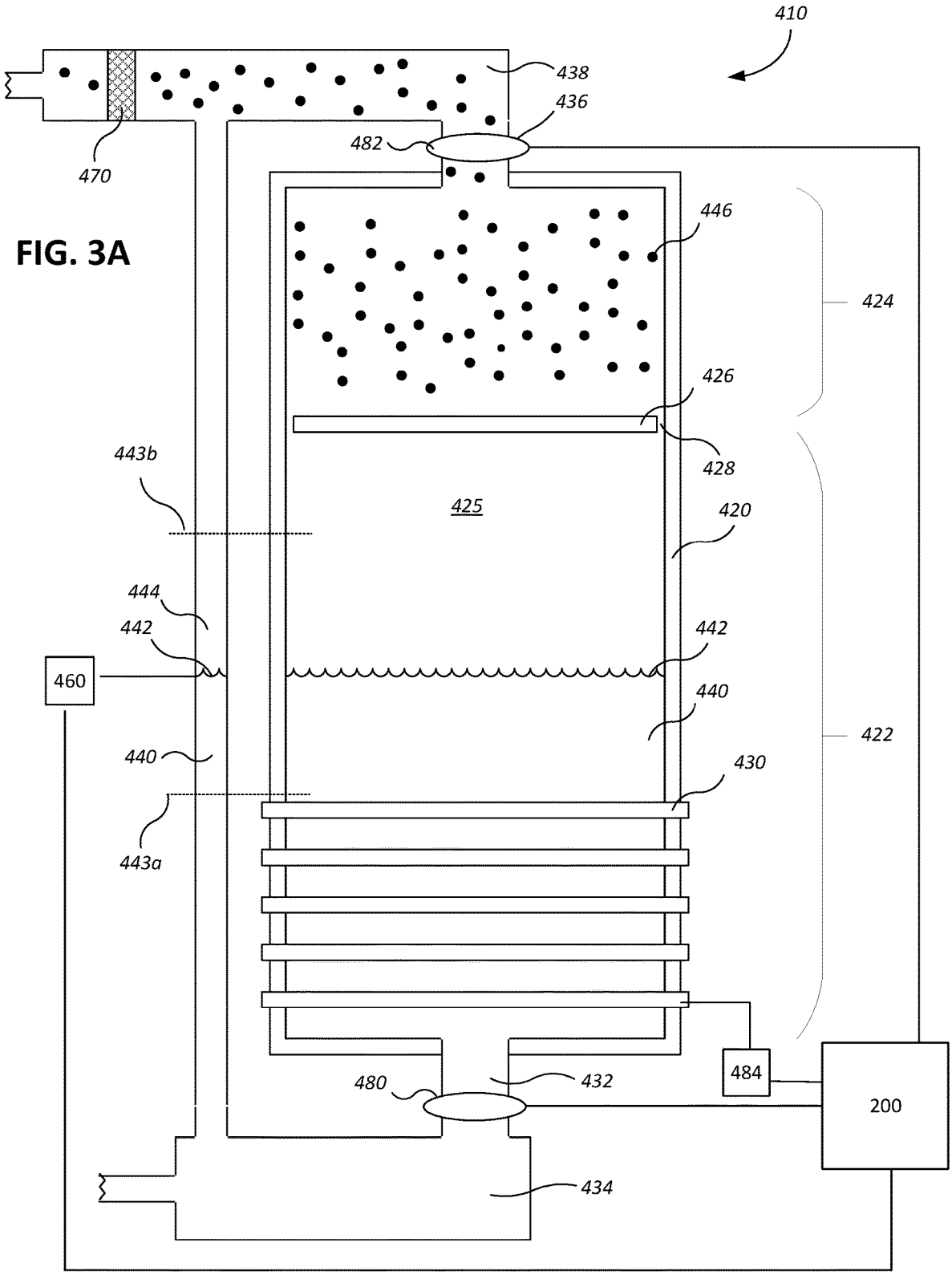
FIG. 3A is a schematic cross-sectional view of an example steam generator.

Referring to FIG. 3A, steam for the processes described in this description, or for other uses in a chemical mechanical polishing system, can be generated using the steam generator 410. An exemplary steam generator 410 can include a canister 420 that encloses an interior volume 425. The walls of the canister 420 can be made of a thermally insulating material with a very low level of mineral contaminants, e.g., quartz. Alternatively, the walls of the canister could be formed of another material, e.g., and an interior surface of the canister could be coated with polytetrafluoroethylene (PTFE) or another plastic. In some implementations, the canister 420 can be 10-20 inches long, and 1-5 inches wide.

Figure 3B:
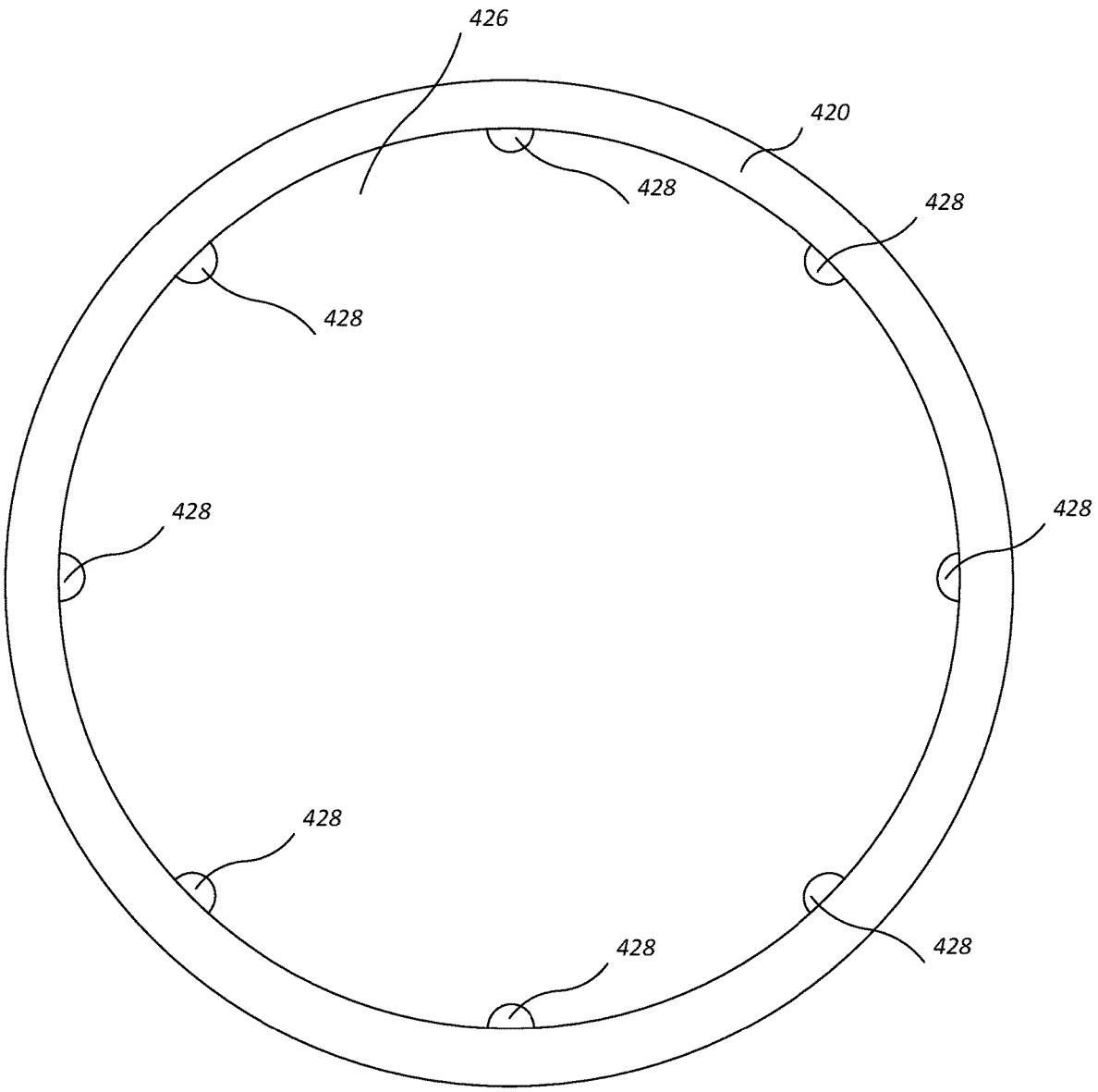
FIG. 3B is a schematic cross-sectional top view of an example steam generator.

Referring to FIGS. 3A and 3B, in some embodiments, the interior volume 425 of the canister 420 is divided into a lower chamber 422 and an upper chamber 424 by a barrier 426. The barrier 426 can be made of the same material as the canister walls, e.g., quartz, stainless steel, aluminum, or a ceramic such as alumina. Quartz may be superior in terms of lower risk of contamination. The barrier 426 can substantially prevent the liquid water 440 from entering the upper chamber 424 by blocking water droplets splattered by the boiling water. This permits the dry steam to accumulate in the upper chamber 424.

The barrier 426 includes one or more apertures 428. The apertures 428 permit the steam to pass from the lower chamber 422 into the upper chamber 424. The apertures 428—and particularly the apertures 428 near the edge of the barrier 426—can allow for condensate on the walls of the upper chamber 424 to drip down into the lower chamber 422 to reduce the liquid content in the upper chamber 426 and permit the liquid to be reheated with the water 440.

The apertures 428 can be located at the edges, e.g., only at the edges, of the barrier 426 where the barrier 426 meets the inner walls of the canister 420. The apertures 428 can be located near the edges of the barrier 426, e.g., between the edge of the barrier 426 and the center of the barrier 426. This configuration can be advantageous in that the barrier 426 lacks apertures in the center and thus has reduced risk of liquid water droplets entering the upper chamber, while still permitting condensate on the side walls of the upper chamber 424 to flow out of the upper chamber.

However, in some implementations, apertures are also positioned away from the edges, e.g., across the width of the barrier 426, e.g., uniformly spaced across the area of the barrier 425.

Referring to FIG. 3A, a water inlet 432 can connect a water reservoir 434 to the lower chamber 422 of the canister 420. The water inlet 432 can be located at or near the bottom of the canister 420 to provide the lower chamber 422 with water 440.

One or more heating elements 430 can surround a portion of the lower chamber 422 of the canister 420. The heating element 430, for example, can be a heating coil, e.g., a resistive heater, wrapped around the outside of the canister 420. The heating element can also be provided by a thin film coating on the material of the side walls of the canister; if current is applied then this thin film coating can serve as a heating element.

The heating element 430 can also be located within the lower chamber 422 of the canister 420. For example, the heating element can be coated with a material that will prevent contaminants, e.g., metal contaminants, from the heating element from migrating into the steam.

The heating element 430 can apply heat to a bottom portion of the canister 420 up to a minimum water level 443*a*. That is, the heating element 430 can cover portions of the canister 420 that is below the minimum water level 443*a* to prevent overheating, and to reduce unnecessary energy expenditures.

A steam outlet 436 can connect the upper chamber 424 to a steam delivery passage 438. The steam delivery passage 438 can be located at the top or near the top of the canister 420, e.g., in the ceiling of the canister 420, to allow steam to pass from the canister 420 into the steam delivery passage 438, and to the various components of the CMP apparatus. The steam delivery passage 438 can be used to funnel steam towards various areas of the chemical mechanical polishing apparatus, e.g., for steam cleaning and preheating of the carrier head 70, substrate 10, and pad conditioner disk 92.

In some implementations, a filter 470 is coupled to the steam outlet 438 configured to reduce contaminants in the steam 446. The filter 470 can be an ion-exchange filter.

Water 440 can flow from the water reservoir 434 through the water inlet 432 and into the lower chamber 422. The water 440 can fill the canister 420 at least up to a water level 442 that is above the heating element 430 and below the barrier 426. As the water 440 is heated, gas media 446 is generated and rises through the apertures 428 of the barrier 426. The apertures 428 permit steam to rise and simultaneously permit condensation to fall through, resulting in a gas media 446 in which the water is steam that is substantially free of liquid (e.g., does not have liquid water droplets suspended in the steam).

In some implementations, the water level is determined using a water level sensor 460 measuring the water level 442 in a bypass tube 444. The bypass tube connects the water reservoir 434 to the steam delivery passage 438 in parallel with the canister 420. The water level sensor 460 can indicate where the water level 442 is within the bypass tube 444, and accordingly, the canister 420. For example, the water level sensor 444 and the canister 420 are equally pressured (e.g., both receive water from the same water reservoir 434 and both have the same pressure at the top, e.g., both connect to the steam delivery passage 438), so the water level 442 is the same between the water level sensor and the canister 420. In some embodiments, the water level 442 in the water level sensor 444 can otherwise indicate the water level 442 in the canister 420, e.g., the water level 442 in the water level sensor 444 is scaled to indicate the water level 442 in the canister 420.

In operation, the water level 442 in the canister is above a minimum water level 443*a* and below a maximum water level 443*b*. The minimum water level 443*a* is at least above the heating element 430, and the maximum water level 443*b* is sufficiently below the steam outlet 436 and the barrier 426 such that enough space is provided to allow gas media 446, e.g., steam, to accumulate near the top of the canister 420 and still be substantially free of liquid water.

In some implementations, the controller 200 is coupled to a valve 480 that controls fluid flow through the water inlet 432, a valve 482 that controls fluid flow through the steam outlet 436, and/or the water level sensor 460. Using the water level sensor 460, the controller 200 is configured to regulate the flow of water 440 going into the canister 420 and regulate the flow of gas 446 leaving the canister 420 to maintain a water level 442 that is above the minimum water level 443*a* (and above the heating element 430), and below the maximum water level 443*b* (and below the barrier 426, if there is a barrier 426). The controller 200 can also be coupled to the power supply 250 for the heating element 430 in order to control the amount of heat delivered to the water 440 in the canister 420.

Although measurements of pad temperature and delivery of steam onto the pad are discussed, this should be understood as including measurements of the slurry on the pad or delivery of steam onto slurry on the pad.

A number of embodiments of the invention have been described. Nevertheless, it will be understood that various modifications may be made without departing from the spirit and scope of the invention. Accordingly, other embodiments are within the scope of the following claims.

What is claimed is:

1. A chemical mechanical polishing system, comprising:
a platen to support a polishing pad;
a carrier head to hold a substrate in contact with the polishing pad;

a motor to generate relative motion between the platen and the carrier head;

a steam generator including a vessel having a water inlet and a steam outlet, and a heating element configured to apply heat to a portion of a lower chamber of the steam generator to generate steam;

an arm extending over the platen having at least one opening oriented to deliver steam from the steam generator onto the polishing pad;

a first valve in a fluid line between the opening and the steam outlet to controllably connect and disconnect the opening and the steam outlet;

a second pressure release valve coupled to the fluid line between the opening and the steam outlet, the second pressure release valve configured to bleed pressure off the steam generator;

a sensor to monitor a steam parameter in the steam generator; and a control system coupled to the sensor, the first valve, the second pressure release valve, and optionally to the heating element, the control system configured to cause the first valve to open and close in accordance with a steam delivery schedule in a polishing process recipe that alternates between a recuperation phase and a dispense phase, the polishing process recipe stored as data in a non-transitory storage device, receive a measured value for the steam parameter from the sensor, receive a target value for the steam parameter, and perform a proportional integral derivative control algorithm with the target value and measured value as inputs so as to control the second pressure release valve and/or the heating element such that the measured value reaches the target value substantially just before a beginning of a next dispense phase and opening the first valve according to the steam delivery schedule, wherein a plurality of gain values of the proportional integral derivative control algorithm are selected to minimize a time that the measured value is at the target value before the next dispense phase begins and the first valve opens delivering steam from the steam generator onto the polishing pad.

2. The system of claim 1, wherein the steam parameter is steam temperature, the measured value is a measured steam temperature value, and the target value is a target steam temperature value.

3. The system of claim 1, wherein the steam parameter is steam pressure, the measured value is a measured steam pressure value, and the target value is a target steam pressure value.

4. The system of claim 1, wherein the control system is configured to perform the proportional integral derivative control algorithm so as to control the first valve during times other than a delivery period in the steam delivery schedule.

5. The system of claim 1, wherein the control system is configured to perform the proportional integral derivative control algorithm so as to control the heating element.

6. The system of claim 1, wherein the control system is configured to perform the proportional integral derivative control algorithm such that the measured value reaches the target value less than 10 seconds before the first valve is opened.

7. The system of claim 6, wherein the control system is configured to perform the proportional integral derivative control algorithm such that the measured value reaches the target value less than 3 seconds before the first valve is opened.

8. The system of claim 7, wherein the control system is configured to perform the proportional integral derivative control algorithm such that the measured value reaches the target value less than 1 second before the first valve is opened.

9. The system of claim 1, comprising a water level sensor to monitor a water level in the vessel, and wherein the control system is configured to receive a signal from the water level sensor and to modify a flow rate of water through the water inlet based on the signal from the water level sensor to keep a water level in the vessel above the heating element and below the steam outlet.

10. The system of claim 1, wherein the control system is configured to open the first valve during a dispense phase of a cycle and configured to close the first valve during a recuperation phase of the cycle.

11. The system of claim 10, wherein each cycle corresponds to polishing of a single substrate.

12. The system of claim 10, wherein each cycle consists of a single dispense phase and a single recuperation phase.

13. The system of claim 10, further comprising a temperature sensor position to measure a temperature of the polishing pad.

14. The system of claim 13, wherein the control system is configured to receive a signal representing the temperature of the polishing pad from the sensor and to set the target value for the steam parameter based on the signal.

15. The system of claim 14, wherein the control system is configured to set the target value on a cycle-by-cycle basis.

16. The system of claim 14, wherein the control system is configured to set the target value on a continuous basis through a cycle.

17. The chemical mechanical polishing system of claim 1, wherein the plurality of gain values comprise a $K_P$, $K_I$, and $K_D$ pre-selected during a tuning operation such that $K_P$ is kept as low as possible, and then $K_I$ and $K_D$ are increased based on overshoot and settling time such that the target value is achieved just before the beginning of the next dispense phase.

18. A chemical mechanical polishing system, comprising:

a platen to support a polishing pad;

a carrier head to hold a substrate in contact with the polishing pad;

a motor to generate relative motion between the platen and the carrier head;

a steam generator including a vessel having a water inlet and a steam outlet, and a heating element configured to apply heat to a portion of lower chamber to generate steam;

an arm extending over the platen having at least one opening oriented to deliver steam from the steam generator onto the polishing pad;

a first valve in a fluid line between the opening and the steam outlet to controllably connect and disconnect the opening and the steam outlet;

a second valve or flow regulator in the fluid line between the first valve and the steam outlet, the second valve configured to controllably bleed pressure from the vessel;

a sensor to monitor a steam parameter; and a control system coupled to the sensor, the first valve, the second valve, and optionally to the heating element, the control system configured to cause the first valve to open and close in accordance with a steam delivery schedule in a polishing process recipe that alternates between a recuperation phase and a dispense phase, the polishing process recipe stored as data in a non-transitory storage device, receive a measured value for the steam parameter from the sensor, receive a target value for the steam parameter, and perform a proportional integral derivative control algorithm with the target value and measured value as inputs so as to control the second valve such that the measured value reaches the target value substantially just before the first valve is opened according to the steam delivery schedule, wherein a plurality of gain values of the proportional integral derivative control algorithm are selected to minimize a time that the measured value is at the target value before a next dispense phase begins and the first valve opens delivering steam from the steam generator onto the polishing pad.

19. A steam generation assembly, comprising:

a steam generator including a vessel having a water inlet and a steam outlet, and a heating element configured to apply heat to a portion of lower chamber to generate steam;

a first valve in a fluid line from the steam outlet to controllably connect and disconnect steam outlet to and from an opening positioned to deliver steam from the steam generator onto a component of a polishing system;

a sensor to monitor a steam parameter; and a control system coupled to the sensor, the first valve and a second valve and optionally to the heating element, the control system configured to cause the first valve to open and close in accordance with a steam delivery schedule in a polishing process recipe that alternates between a recuperation phase and a dispense phase, the polishing process recipe stored as data in a non-transitory storage device, receive a measured value for the steam parameter from the sensor, receive a target value for the steam parameter, and perform a proportional integral derivative control algorithm with the target value and measured value as inputs so as to control the first valve and/or a second pressure release valve, the second pressure release valve coupled to the fluid line between the opening and the steam outlet, the second pressure release valve configured to bleed pressure off the steam generator, and/or the heating element such that the measured value reaches the target value substantially just before the first valve is opened according to the steam delivery schedule, wherein a plurality of gain values of the proportional integral derivative control algorithm are selected to minimize a time that the measured value is at the target value before a next dispense phase begins and the first valve opens delivering steam from the steam generator.

20. A computer program product, comprising a non-transitory computer-readable medium having instructions to cause one or more processors to:

access a polishing process recipe stored as data in a non-transitory storage device;

cause a first valve between an outlet of a steam generation device and an opening to open and close in accordance with a steam delivery schedule that alternates between a recuperation phase and a dispense phase;

receive from a sensor a measured value for a steam parameter of steam in the steam generation device;

receive a target value for the steam parameter and perform a proportional integral derivative control algorithm with the target value and measured value as inputs so as to control the first valve and/or a second pressure release valve, the second pressure release valve coupled to a fluid line between the opening and the outlet of the steam generation device, the second pressure release valve configured to bleed pressure off the steam generation device, and/or a heating element such that the measured value reaches the target value substantially just before the first valve is opened according to the steam delivery schedule, wherein a plurality of gain values of the proportional integral derivative control algorithm are selected to minimize a time that the measured value is at the target value before a next dispense phase begins and the first valve opens delivering steam from the steam generation device.

* * * * *